US005881536A

United States Patent [19]

Müller-Wille et al.

[11] Patent Number: 5,881,536

[45] Date of Patent: Mar. 16, 1999

[54] METHOD FOR STERILE PACKING OF A SUBSTANCE

[76] Inventors: Per Müller-Wille, Stora Trädgårdsgatan 20:320, S-211 28 Malmö ; Lars Åke Alvar Lidgren, Örnvägen 35, S-227 31 Lund, both of Sweden

[21] Appl. No.: 821,038

[22] Filed: Mar. 20, 1997

[30] Foreign Application Priority Data

Mar. 20, 1996 [SE] Sweden ..... 9601078

[51] Int. Cl.[6] ..... B65B 55/04; B65B 55/12

[52] U.S. Cl. ..... 53/426; 53/425; 53/449

[58] Field of Search ..... 141/92; 53/141, 53/167, 175, 425, 426, 449

[56] References Cited

U.S. PATENT DOCUMENTS

| | | | |
|---|---|---|---|
| 3,464,085 | 9/1969 | Burkett et al. | 53/140 X |
| 3,685,248 | 8/1972 | Godelaine | 53/425 |
| 4,088,264 | 5/1978 | Vogt . | |
| 4,235,725 | 11/1980 | Semersky | 53/425 X |
| 4,467,588 | 8/1984 | Carveth | 53/425 |
| 4,969,915 | 11/1990 | Hatanaka et al. | 53/426 X |
| 4,998,400 | 3/1991 | Suzuki et al. | 53/425 |
| 5,031,673 | 7/1991 | Clusserath | 141/92 X |
| 5,322,095 | 6/1994 | Bolz | 141/93 X |
| 5,382,406 | 1/1995 | Kruger et al. | 53/426 X |
| 5,549,380 | 8/1996 | Lidgren et al. . | |
| 5,641,004 | 6/1997 | Py | 53/403 X |
| 5,715,646 | 2/1998 | Smekens | 53/167 X |

FOREIGN PATENT DOCUMENTS

| | | |
|---|---|---|
| 0303135 | 2/1989 | European Pat. Off. . |
| 0674888 | 10/1995 | European Pat. Off. . |
| 3701915 | 8/1988 | Germany . |
| 0470996 | 4/1969 | Switzerland . |
| 1148645 | 4/1969 | United Kingdom . |
| 9606780 | 3/1996 | WIPO . |

*Primary Examiner*—Daniel B. Moon

*Attorney, Agent, or Firm*—Tarolli, Sundheim, Covell, Tummino & Szabo

[57] ABSTRACT

The present invention relates to a method and device for sterile packing of a substance (2) in a container (1), whereby said substance (2) can not stand the same sterilizing process as the one said container (1) is subjected to. The container (1) is sterilized without containing said substance (2) and while being enclosed in an outer package (4) so that said container (1) becomes internally and externally sterile. Thereafter, said substance (2), which has been sterilized in another way, is inserted into the container (1) without contaminating neither the container (1) nor the substance (2) during said insertion of said substance (2) into said container (1).

27 Claims, 3 Drawing Sheets

METHOD FOR STERILE PACKING OF A SUBSTANCE

Figure 1:
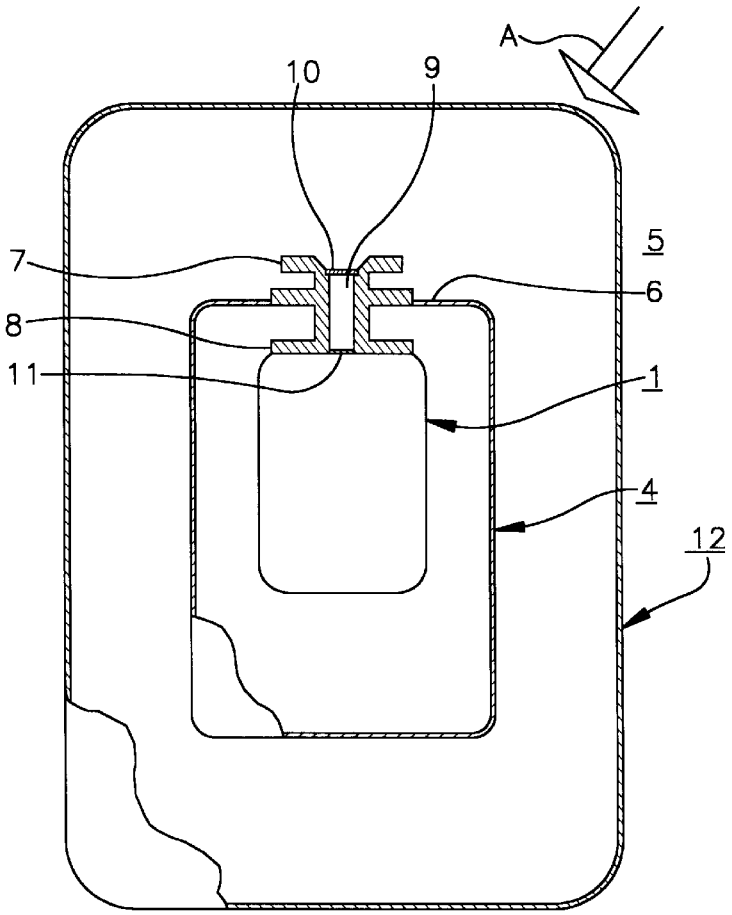

The present invention relates to a method for sterile packing of a substance in a container, whereby said substance can not stand the same sterilizing process as the one said container is subjected to. The invention also relates to a device at such a sterile packing.

In the food industry, the pharmaceutical industry and the medicine technical industry, sterilized products are usually required. These products may consist of a container with a content and an outer package.

If the content in the container is a liquid which may not be subjected to such radiation or heat which is often utilized for sterilization of products, aseptic filling of the container must be carried through. This means that the container is first sterilized on the inside, after which liquid is added in sterilized condition, meaning that no bacteria or particles remain therein.

On certain occations in, inter alia, the orthopaedics, the filled container must also be packed in sterile condition in an outer package. This outer package must be impermeable to bacteria and virus—i.e. it must define a so called sterile barrier—but it must also be permeable to such gas (e.g. ethylene oxide) which is often used for sterilization. Gas sterilization of the outer package is carried through by subjecting said package, with its container filled with liquid, to said gas.

In, inter alia, orthopaedics, radiative sterilization may also be utilized for sterile packing of a container in an outer package. This means that the outer package is subjected to e.g. gamma or beta radiation which is penetrating so that the container is sterilized internally as well as externally.

If said sterilization affects the liquid in the container in an undesired manner, the package is subjected to radiative sterilization with an empty container. When the radiation treatment is finished, the outer package is normally maintained until the container shall be filled, but is removed before the filling operation. This means that the container during filling no longer is sterile, but that sterile packing is carried through in a subsequent moment at which the filled container is placed in an outer package, after which said outer package and the no longer sterile outer side of said container are sterilized. This sterilization can be of the gas sterilizing type as described above for not affecting the content in the container in an undesired manner.

A drawback with said latter method is that the container must be packed in sterile condition twice, namely once when it is empty and a second time after filling thereof, which means that the manufacturing method is circumstantial and expensive.

The object of the present invention has been to eliminate this drawback and thus, provide a more simple and less expensive packing method than previously.

The object of the invention has also been to provide a simple and effective device at said packing method.

By means of said method and device, an internally and externally sterile container is obtained, which container has been sterilized in another sterilizing process than a substance contained therein.

Figure 2:
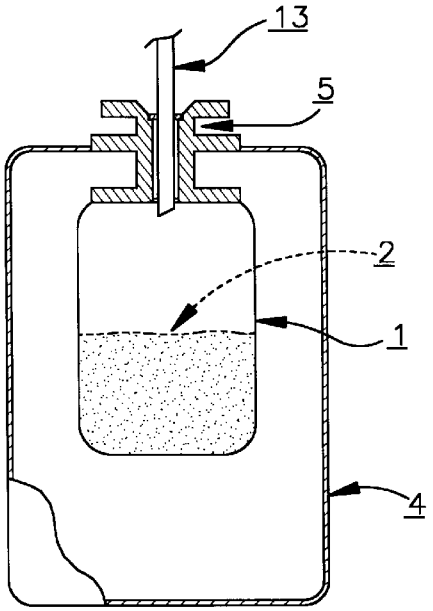
Figure 3:
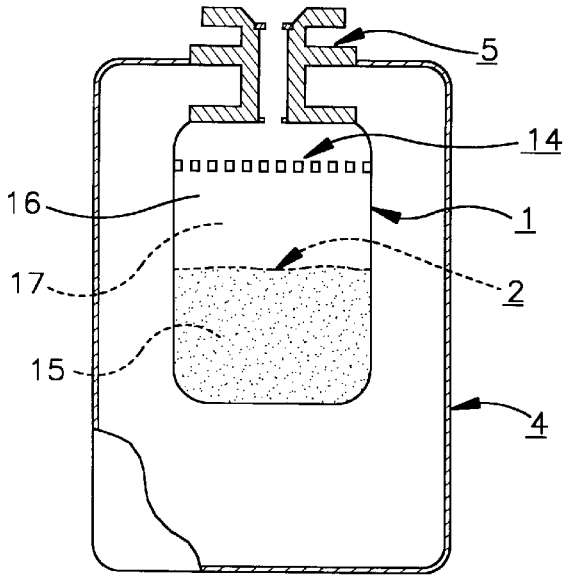
Figure 4:
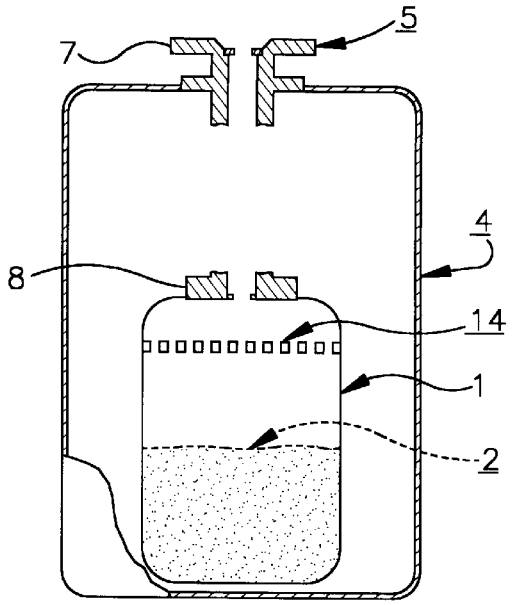
Figure 5:
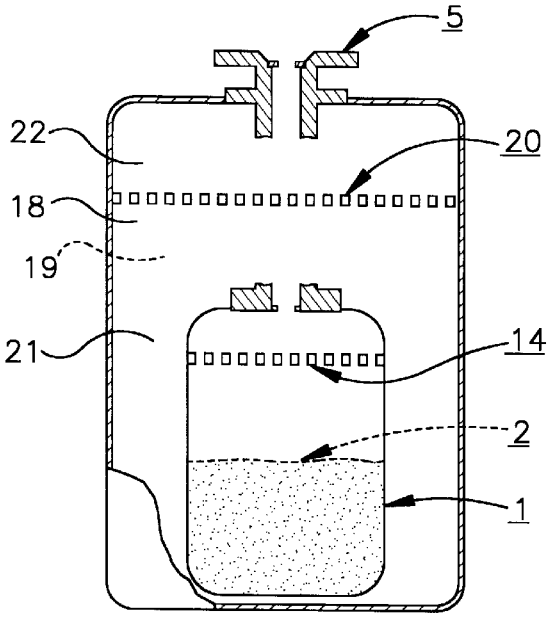
Figure 6:
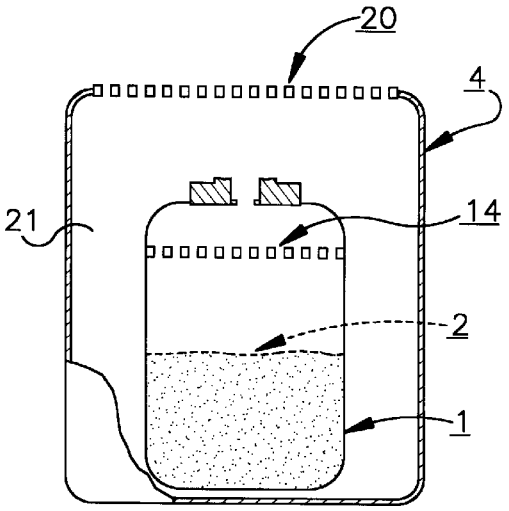
Figure 7:
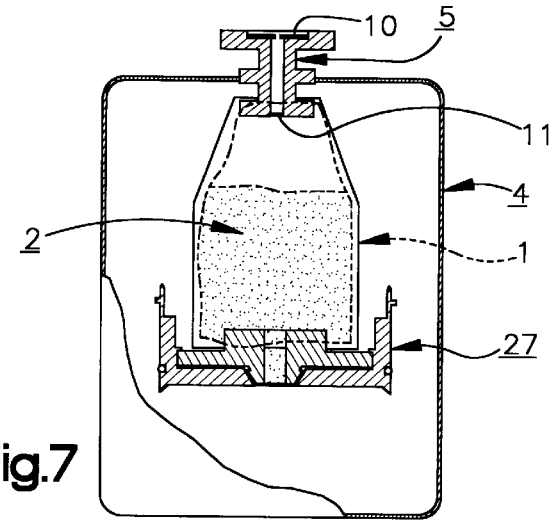
Figure 8:
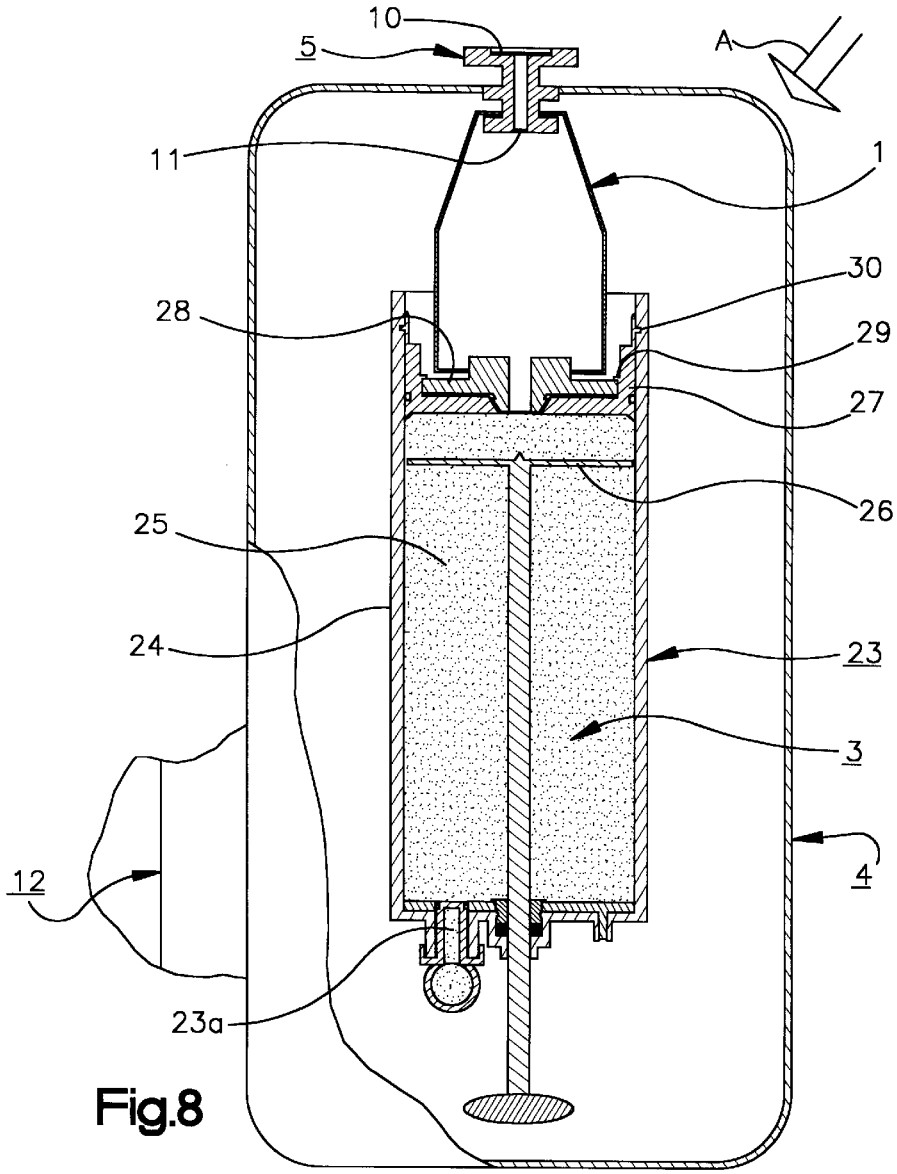

The invention will be further described below with reference to the accompanying drawings, in which FIG. 1 schematically illustrates a package according to the invention during a sterilizing operation;

FIG. 2 schematically illustrates the package according to FIG. 1 during a filling operation;

FIG. 3 schematically illustrates the package according to FIG. 1 during a sealing operation;

FIG. 4 schematically illustrates the package according to FIG. 1 during a disconnecting operation;

FIG. 5 schematically illustrates the package according to FIG. 1 during a further sealing operation;

FIG. 6 schematically illustrates the package according to FIG. 1 after a separating operation;

FIG. 7 schematically illustrates a package according to the invention, but with another content than the abovementioned package; and FIG. 8 schematically illustrates a package according to the invention, but with another content than the abovementioned packages.

The method according to the invention relates to sterile packing of a substance 2 in a container 1, whereby said substance 2 can not stand the same sterilizing process as the one said container 1 is subjected to.

In this method, the container 1 is sterilized without containing said substance 2 and while being enclosed in an outer package 4 so that said container 1 becomes internally and externally sterile. Thereafter, said substance 2, which has been sterilized in another way, is inserted into the container 1 without contaminating neither the container 1 nor the substance 2 during said insertion of said substance 2 into said container 1.

The container 1 illustrated in the drawings is designed as a bag and may consist of a flexible, thin-walled material of a suitable type. The substance 2 in the container 1 may be a sterile liquid component 2, preferably a monomer, which is adapted for mixing with a sterile powder component 3, preferably a polymer, for the manufacture of bone cement.

Said container 1 is adapted to be placed in the outer package 4 in an internally as well as externally sterilized condition. The outer package 4 may have the shape of a bag and may consist of a flexible, thin-walled material of a suitable type. The container 1 is preferably connected to the outer package 4 through a fixing means 5, which is provided on a wall portion 6 of the outer package 4 so that outer members 7 of said fixing means 5 are accessible from the outside and so that inner members 8 thereof are located inside said outer package 4, whereby the container 1 is mounted on or attached to said inner members 8. The fixing means 5 has a through filler hole 9 extending from the outside into the container 1. The filler hole 9 can be closed by means of a closing means 10 which can be located on the outer members 7 of the fixing means 5 outside the outer package 4. As an alternative thereto or in combination with the closing means 10, there may be another closing means 11 which is adapted to close the filler hole 9 and which may be provided on the inner members 8 of the fixing means 5 inside the outer package 4.

The outer package 4 may in turn be provided in an additional outer package 12 of flexible, thin-walled material of a suitable type and the container 1, the outer package 4 and said additional outer package 12 are completely closed or sealed.

The container 1, the outer package 4 and the additional outer package 12 are subjected to a radiative operation, whereby they are exposed to or treated with penetrating radiation (see arrow A in FIG. 1), e.g. beta or gamma radiation, so that the container 1 as well as the outer package 4 are sterilized internally and externally. The outer package 4 is sterilized externally while it is located in the additional outer package 12.

The sterile liquid component 2 is hereby not poured in the container 1, whereby it is ensured that said liquid component is not negatively affected during the radiative operation.

Then, the product is brought to a filling station at which the additional outer package 12 is removed. At the filling station the sterile liquid component 2 is poured in the internally sterile container 1. Hereby, a filler unit 13, e.g. a filler pipe, can be inserted so far into the filler hole 9 of the fixing means 5 that the closing means 10 as well as the closing means 11, if any, is/are penetrated.

The filler unit 13, the area where said filler unit 13 penetrates the closing means 10 of the outer package 4 and the atmosphere adjacent thereto are sterile. This sterilization can be carried through e.g. by injecting gas, e.g. hydrogen peroxide, around the filler area. Alternatively, filling of the container 1 may take place in a sterile environment. If so, the outer package 4 with the inner package or container 1 can be removed from the additional outer package 12 in which they have been packed in sterile condition, and through air locks be brought into the filling station, whereby said air locks guarantee that a non-contaminated outer package 4 with the container 1 reaches the filling station.

After the filling operation, the filler unit 13 is withdrawn from the filler hole 9 and then, sealing means which is provided sterile in the outer package 4 is sealed so that the liquid component 2 which is packed in sterile condition in the container 1 can not flow out through said filler hole 9.

Said sealing means may be of various types and located in sterile condition in various places in the outer package 4. Thus, said sealing means may e.g. be a seal 14 of that part 15 of the container 1 which contains said liquid component 2. The seal 14 may be provided by heating the container 1 through the walls of the outer package 4 such that opposing wall portions 16, 17 of the container 1 melt together. This heating is carried through preferably without the walls 18, 19 of the outer package 4 melting together with the container 1. The operation preventing said melting together or fusion can be arrived at in different ways, e.g. by manufacturing the container 1 and/or the outer package 4 of a material and/or coating said container 1 and/or outer package 4 with a material which prevents melting together or fusion of said members. Alternatively, the container 1 may consist of a material which melts at a lower temperature than the material of the outer package 4.

As an alternative sealing means one should mention the closing means 11 provided in the outer package, which closing means 11 may either be self-closing when the filler unit 13 is withdrawn therefrom or be accessible from outside the outer package 4 for closing without opening the outer package 4.

After sealing of said sealing means 14 or closing means 11, the container 1 is released from the wall portion 6 of the outer package 4 so that said container 1 will lie loose in said outer package 4. This is arrived at by disassembling or separating (e.g. breaking) the fixing means 5 as is shown in FIG. 4 or by disconnecting the container 1 from the fixing means 5.

As is apparent from FIG. 5, the outer package 4 may be provided with a seal 20 between those parts 21 thereof including the container 1 and those parts 22 thereof to which the container 1 has been connected. This seal 20 can be obtained by melting together or fusing the opposing wall portions 18, 19 of the outer package 4 by heating.

From FIG. 6 it is apparent that those parts 22 of the outer package 4 to which the container 1 has been attached, have been removed or separated from the remaining parts 21 of the outer package 4.

During the abovementioned method, the container 1 has been kept sterile a) when it was filled (FIG. 2);

b) when it was sealed by means of the sealing means 14 or closing means 11;

c) until it is taken out of the outer package 4 for use (FIG. 6, which shows the container 1 ready for removal from the outer package 4).

The container 1 is taken out of the outer package 4 and its sterile content, i.e. the liquid component 2, is mixed with the sterile powder component 3 for manufacturing the bone cement. This mixing operation can be carried through in a mixing and discharging device 23 wherein the powder component 3 is packed in sterile condition. The mixing and discharging device 23 can be of the type shown and described in the publication EP 0 674 888, i.e. of the type comprising a mixing container 24 with a mixing space 25 (in which the powder component 3 is packed in sterile condition), a mixing and punching means 26 and a piston means 27.

The container 1 can be provided on the piston means 27 and an opening between the container 1 and the mixing space 25 can be obtained by means of the mixing and punching means 26 so that the liquid component 2 and the powder component 3 can be mixed in the mixing space 25 by means of said mixing and punching means 26 until the bone cement is finished. The bone cement is through an opening 23*a* fed or discharged from the mixing space 25 by displacing the piston means 27 by means of a pressure device (not shown) adapted therefor, whereby the mixing and discharge device 23 is held so that the bone cement is brought directly to the spots where is shall be used.

As is apparent from FIG. 7, the container 1 and the piston means 27 can, when assembled, be located in the outer package 4 during the abovementioned sterilizing and handling procedure, which means that the piston means 27 also is sterilized. When said procedure has ended, the piston means 27 and the container 1 attached thereto can be removed from the outer package 4 in sterile condition and said piston means 27 with said container 1 can be located in its operating position in the mixing and discharge device 23.

As is further apparent from FIG. 7, the entire mixing and discharging device 23 along with the container 1 connected thereto through the piston means 27 or in any other way, be provided in the outer package 4 during said sterilizing and handling procedure, which means that the entire mixing and discharge device 23 is packed in sterile condition along with the container 1. When said procedure has ended, the mixing and discharge device 23, the container 1 included, is sterile internally as well as externally and thus, can be taken out of the outer package 4 in sterile condition. Thereafter, mixing of the bone cement can occur in the mixing and discharge device 23, after which the bone cement can be fed or discharged to the spots intended therefor.

As is shown in FIGS. 7 and 8, the container 1 can be provided on the piston means 27 through a coupling member 28. This coupling member 28 can be snapped onto the piston means 27 e.g. by pressing it in and behind inwardly directed snap portions 29 on said piston means 27.

The piston means 27 may also have outwardly directed snap portions 30 which are adapted to retain said piston means 27 at the mixing container 24 during mixing operation, but which can be released from the mixing container 24 after said operation so that the piston means 27 can be displaced for discharge of bone cement from the mixing space 25.

The invention is not limited to the abovementioned method or the abovementioned device, but may vary within the scope of the following claims. Thus, said substance 2 may be a totally different substance than a liquid component for the manufacture of bone cement and the container 1 may be connected or attached to the outer package 4 in other ways than through a fixing means 5—a wall portion of the container may e.g. be attached to the inner side of a wall portion of the outer package. Said sealing means may be other means than the seal 14 and/or the closing means 11 since the function thereof, to prevent the substance 2 from leaving the container 1 the same way as it was brought or fed into said container, can be obtained with other constructions.

The radiation treatment of the outer package 4 with the container 1 or the container 1 and the piston means 27 together or the mixing and discharge device 23 with the container 1 or with the container 1 as well as the piston means 27 together, may be another penetrating radiation treatment than gamma or beta radiation.

The outer package 4 (and eventually the additional outer package 12 if provided) and the container 1 may be thin-walled bags of plastic and/or another suitable material.

We claim:

1. A method of sterile packing a substance said method comprising the steps of:

enclosing an empty container in a first outer package;

sterilizing the inside and the outside of the empty container while said container is enclosed in said first outer package;

sterilizing a substance in a manner different from the manner in which said container is sterilized;

inserting said substance into said sterilized container without contaminating said substance and said container after said substance and said container are sterilized;

sealing said container by affecting said container through said first outer package after inserting said substance into said container; and maintaining said substance and said container in a sterile condition within said first outer package until said substance is removed from said container.

2. A method as defined in claim 1 further comprising the step of:

opening said first outer package and said container; and removing said substance in a sterile condition for use.

3. A method as defined in claim 1 wherein said container comprises a flexible, thin-walled material.

4. A method as defined in claim 1 wherein said inside and outside of said first outer package are sterilized before inserting said substance into said container.

5. A method as defined in claim 1 wherein said first outer package comprises a flexible, thin-walled material.

6. A method as defined in claim 1 wherein said container is sealed in a manner effective to prevent said substance from escaping said container after said substance is inserted in said container.

7. A method as defined in claim 6 wherein said container is attached to a wall portion of said first outer package before sealing said container; and wherein said container is sealed at an area of said container between a section of said container containing said substance and said wall portion of said first outer package.

8. A method as defined in claim 7 wherein said container comprises opposite wall members and wherein said container is sealed by melting together said opposite wall members by heating said opposite wall members through said first outer package.

9. A method as defined in claim 8 wherein said container is sealed by melting together said opposite wall members by heating said opposite wall members through said first outer package without melting together said first outer package and said opposite wall members.

10. A method as defined in claim 9 wherein said container and said first outer package comprise material that prevents said container and said first outer package from melting together when said container is sealed by heating through said first outer package.

11. A method as defined in claim 7 further comprising the step of detaching said container from said wall portion of said first outer package after said container has been sealed.

12. A method as defined in claim 11 further comprising the step of sealing said first outer package at an area of said first outer package between said wall portion of said first outer package and said container in a manner effective to prevent said container from escaping said first outer package after said container has been detached from said wall portion.

13. A method as defined in claim 12 wherein said first outer package includes opposite walls and wherein said first outer package is sealed by melting together said opposite walls of said first outer package.

14. A method as defined in claim 12 further comprising the step of removing said wall portion of said first outer package after sealing said first outer package.

15. A method as defined in claim 1 wherein said substance is inserted into said container through a filling hole in a fixing means, said fixing means connecting a wall portion of said first outer package with said container, said filling hole remaining closed during sterilizing of said container and open during inserting of said substance into said container; and further comprising the step of preventing said substance from escaping said container by sealing a sealing means after said substance has been inserted through said filler hole into said container.

16. A method as defined in claim 15 wherein said sealing means seals said container at an area of said container between said fixing means and said substance disposed in said container.

17. A method as defined in claim 15 wherein said sealing means comprises a closing means disposed inside said first outer package, said closing means remaining open during inserting of said substance into said container.

18. A method as defined in claim 15 further comprising the step of detaching said container from said wall portion of said first outer package after sealing said container.

19. A method as defined in claim 1 wherein said substance comprises a liquid component which is adapted to be mixed with a powder component to form a bone cement; and further comprising the steps of mixing said liquid component and said powder component in a mixing and discharging device after maintaining said substance and said container in a sterile condition within said first outer package; and discharging said bone cement from said mixing and discharging device when using said bone cement.

20. A method as defined in claim 19 further comprising the steps of:

removing said container in a sterile condition from said first outer package after maintaining said substance and said container in a sterile condition within said first outer package;

positioning said container on said mixing and discharging device before mixing said liquid component and said powder component.

21. A method as defined in claim 19 wherein said container includes a piston means and wherein said bone cement is discharged from said mixing and discharging device by displacing said substance with said piston means.

22. A method as defined in claim 19 further comprising the steps of:

providing said mixing and discharging device in a sterile condition in said first outer package;

positioning said container on a piston means of said mixing and discharging device;

removing said mixing and discharging device and said container from said first outer package before mixing said liquid component and said powder component to form bone cement; and wherein said bone cement is discharged from said mixing and discharging device by displacing said bone cement with said piston means.

23. A method as defined in claim 1 wherein said container and said first outer package are sterilized by radiation treatment before said substance is inserted into said container.

24. A method as defined in claim 23 further comprising the steps of:

enclosing said first outer package in a second outer package before sterilizing said container and said first outer package; and removing said additional outer package from said first outer package before inserting said substance into said container.

25. A method as defined in claim 1 further comprising the steps of:

providing a mixing and discharging device within said first outer package before sterilizing said container and said first outer package;

enclosing said first outer package in a second outer package before sterilizing said container;

wherein said mixing and discharging device, said container, said first outer package, and said second outer package are sterilized by radiation treatment; and wherein said substance is a liquid component adapted for mixing with a powder component in said mixing and discharging device.

26. A method as defined in claim 1 wherein said substance is inserted into said container at a sterile filling station.

27. A method as defined in claim 1 wherein said substance is inserted into said container by means of a sterile filling unit within a sterile atmosphere.

* * * * *